United States Patent [19]

Shida et al.

[11] 4,326,278

[45] Apr. 20, 1982

[54] ELECTRONIC TIMEPIECE

[75] Inventors: Masaharu Shida; Makoto Ueda; Akira Torisawa; Shuji Owada; Masaaki Mandai, all of Tokyo, Japan

[73] Assignee: Kabushiki Kaisha Daini Seikosha, Japan

[21] Appl. No.: 966,115

[22] Filed: Dec. 4, 1978

[30] Foreign Application Priority Data

Dec. 2, 1977 [JP] Japan ..... 52-144651

[51] Int. Cl.[3] ..... G04B 19/00; G04F 5/00

[52] U.S. Cl. ..... 368/157; 318/696

[58] Field of Search ..... 58/23 R, 23 D, 28 R, 58/28 A, 28 B, 28 D; 318/685, 696; 368/85, 86, 87, 217, 218, 219, 76, 155–159

[56] References Cited

U.S. PATENT DOCUMENTS

| | | | |
|---|---|---|---|
| 3,855,781 | 12/1974 | Chihara et al. | 58/23 D X |
| 3,963,946 | 6/1976 | Zajac | 318/696 X |
| 4,031,448 | 6/1977 | Adachi | 318/685 X |
| 4,032,827 | 6/1977 | Dobratz et al. | 318/685 X |
| 4,114,364 | 9/1978 | Takahashi | 58/23 D |
| 4,209,971 | 7/1980 | Ueda et al. | 368/87 X |
| 4,212,156 | 7/1980 | Kawamura et al. | 368/85 |

FOREIGN PATENT DOCUMENTS

| | | | |
|---|---|---|---|
| 2817622 | 10/1978 | Fed. Rep. of Germany | 58/23 D |

*Primary Examiner*—Vit W. Miska

*Attorney, Agent, or Firm*—Robert E. Burns; Emmanuel J. Lobato; Bruce L. Adams

[57] ABSTRACT

An electronic timepiece having a stepping motor including a stator, rotor and coil, a driving circuit for applying driving pulses to the coil, an oscillating circuit for generating a time standard signal and a dividing circuit for dividing the time standard signal, is provided with a pulse combining circuit receptive of the output of the dividing circuit for producing a correction driving pulse having sufficient effective power to drive the motor under worst case conditions, a detector for detecting the rotation or non-rotation condition of the rotor after the application to the coil by the driving circuit of a normal driving pulse having less effective power than the correction driving pulse, and a controller for the driving circuit to apply normal driving pulses to the coil and responsive to the output of the detector to apply a correction driving pulse when a non-rotation condition is detected. The power consumption due to the pulse driving of the motor is minimized by incrementally decreasing the effective power of successive normal driving pulses and by incrementally increasing the effective power of successive normal driving pulses in response to the detection of a non-rotation condition by the detector.

12 Claims, 29 Drawing Figures

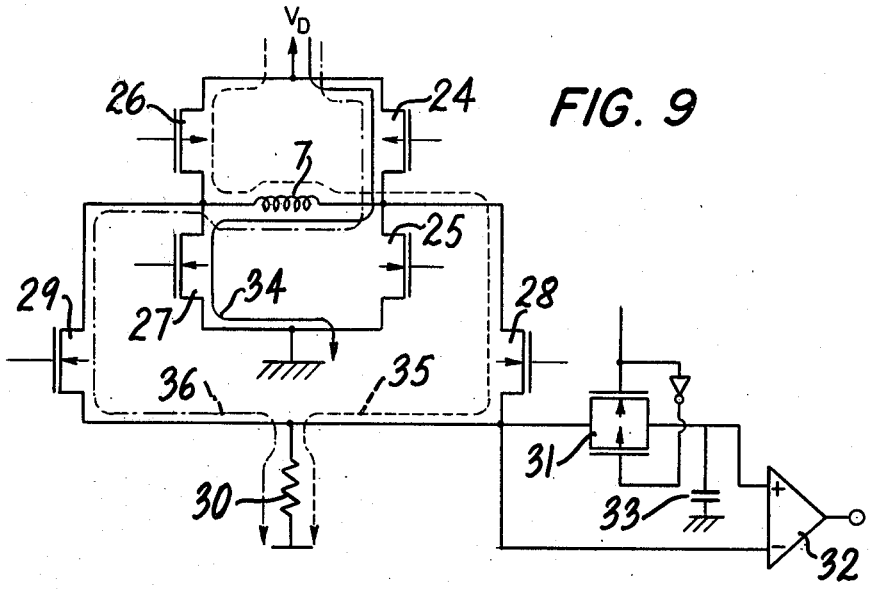
FIG. 9
FIG. 10a
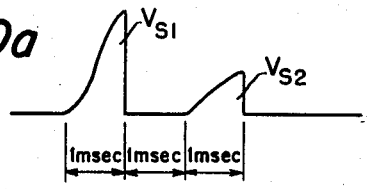
FIG. 10b
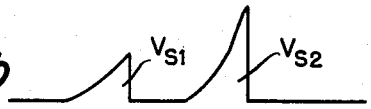
FIG. 11a
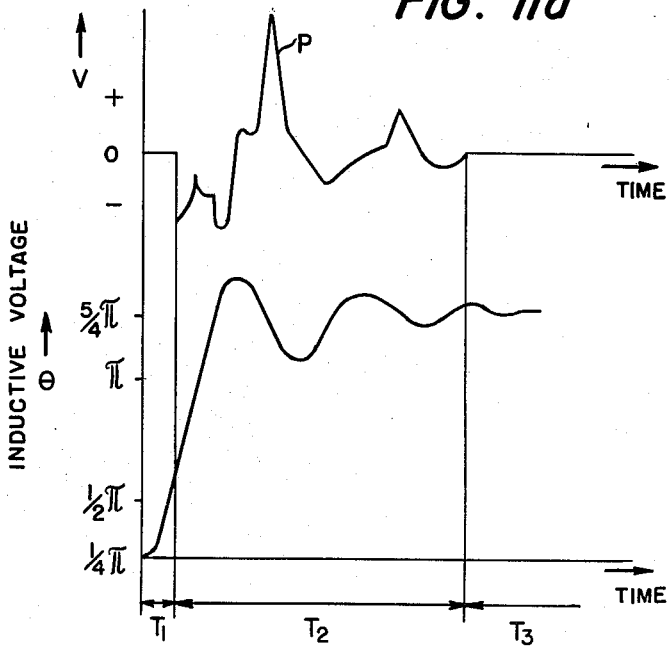
FIG. 11b
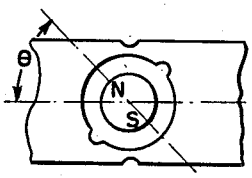

ELECTRONIC TIMEPIECE

BACKGROUND OF INVENTION

The present invention relates generally to electronic timepieces of the analog type.

In the prior art, a commonly used display mechanism for an analog display type quartz timepiece is arranged as shown in FIG. 1. The output of a stopping motor comprised of a stator 1, a coil 7 and a rotor 6 is transmitted to a wheel train having wheels 2,3,4, and 5, the output from the wheel train is transmitted to the display mechanisms, such as a second hand, a minute hand and an hour hand, or a calendar device under certain circumstances, through wheel trains (not shown) to drive the display mechanisms.

In FIG. 2, an example of the circuit construction for a conventional electronic timepiece is shown. The frequency of an oscillating signal from an oscillating circuit 10 is divided continuously by a frequency dividing circuit 11. These frequency divided signals are converted into two signals each having a pulse width of 7.8[ms] and a period of 2[sec] are being dephased by 1[sec] from each other by using a pulse combining circuit 12, and these signals are applied to the inputs 15 and 16 of driving inverters 13*a* and 13*b*. Therefore, a reversing driving pulse which changes the direction of the current every one second is applied to the coil 7 and, the rotor 6 magnetized so as to have two poles can be sequentially rotated by steps of 180 degrees. An example of the driving current waveform of the coil is shown in FIG. 3.

The pulse width of the driving pulse (such as 7.8[ms] in the foregoing example), the resistance value of the coil, the number of turns in the coil, the sizes of the parts of the stepping motor and other porometers are designed so as to drive the stepping motor in a stable manner even though the electronic timepiece may be subjected to adverse conditions, such as, the load of the wheel train becomes large due to the addition of calendar function, the timepiece is placed in a magnetic field, or the internal resistance of a battery increases due to low temperature. Therefore, the timepiece dissipates much power so as to assure stable operation under the above-mentioned adverse conditions although the timepiece does not require such a large torque while operating under normal conditions. This fact prevents reduction of the total power consumption in the electronic timepiece.

SUMMARY OF THE INVENTION

The present invention aims to eliminate the foregoing drawbacks in the prior art timepieces, and one major object of the present invention is to reduce the power consumption in the electronic timepiece by supplying driving pulses having a minimum pulse width corresponding to the requirements of the stepping motor under any load condition.

BRIEF DESCRIPTION OF DRAWINGS

FIG. 9 and FIG. 10 are an example of a movement detection circuit for a rotor and an example of the waveform of a detection voltage, respectively;

FIG. 11 and FIG. 13 show the relationship between a rotational angle $\theta$ of a rotor and an induced voltage after driving;

FIG. 11*b* and FIG. 13*b* are schematic representations of angle $\theta$;

DETAILED DESCRIPTION OF PREFERRED EMBODIMENTS

The present invention relates to a driving system for driving a stepping motor of an analog display type electronic timepiece with less power consumption.

Figure 4A:
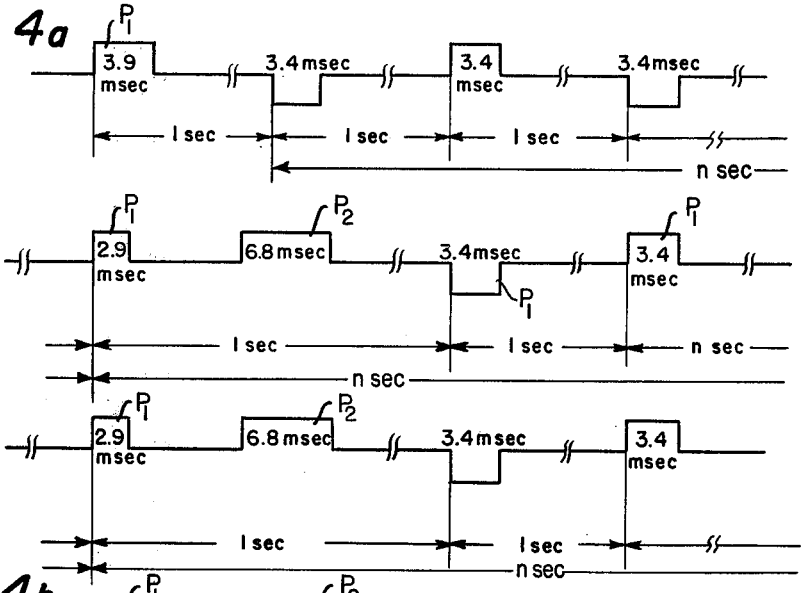
FIGS. 4*a*, 4*b* and 4*c* shows an example of a train of driving pulses applied to a timepiece stepping motor according to the present invention.
Figure 4B:
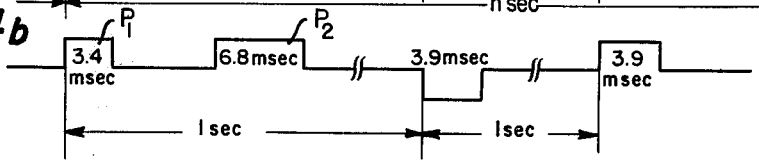
Figure 4C:
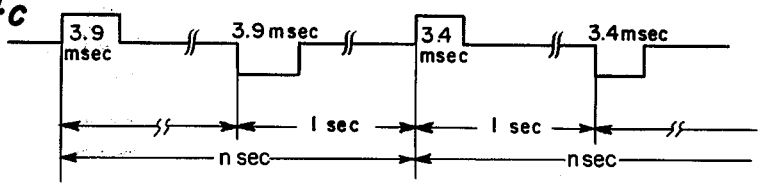

Prior to the detailed explanation of the present invention, an example of the general principle of operation according to the present invention will be explained in conjunction with FIGS. 4*a*, 4*b* and 4*c*.

The driving pulses for the stepping motor used in the electronic timepiece of the present invention are composed of two types of pulses, one is a normal driving pulse, the other is a correction driving pulse. The order of pulses supplied to the stepping motor is first the normal driving pulse and the correction driving pulse; however, the correction driving pulse is supplied to the motor, as a rule, when the stepping motor can not be rotated by the normal driving pulse. Since the supply of the correction driving pulse to the stepping motor indicates that the motor can not be rotated by supplying the normal driving pulse, the pulse width of the next normal driving pulse is made longer by a predetermined width for easily rotating the motor.

On the contrary, the pulse width of the normal driving pulse is made shorter by a predetermined width every preselected number of steps of rotation of the motor, for example, every n number of steps.

Due to the above-mentioned operation, the pulse width of the normal driving pulse $P_1$ becomes the minimum pulse width needed to drive the stepping motor under any load condition. As a result, the power consumption of the stepping motor will be minimized. For example, as shown in FIG. 4*a*, and assuming the motor is operating normally at a pulse width $P_1$ of 3.9 [ms] the above-mentioned operation adjusts the pulse width of $P_1$ of 3.9[ms] to a shorter pulse width of 3.4[ms]. Assuming that the stepping motor can be still rotated in this condition, the bove-mentioned operation adjusts the pulse width of $P_1$ to be 2.9[ms] again after the stepping motor is rotated a few steps by the pulse having a pulse width of 3.4[ms]. Assuming now, however, that the stepping motor is not able to rotate in this condition, the non-rotating condition of the rotor is detected according to the above-mentioned operation, so that the correction pulse $P_2$ is quickly applied to the motor and then, the pulse width of $P_1$ supplied after the subsequent steps is set at 3.4[ms]. After this, the pulse width of the normal driving pulse is maintained at 3.4[ms] by repeating the above-mentioned operation. For some reasons, when the stepping motor falls into the condition that the motor does not rotate by applying the normal driving pulse having a pulse width of 3.4[ms], the non-rotating condition of the rotor is detected by detecting the dgree of angular movement of the rotor as shown in FIG. 4*b* so that a correcting drive is quickly made. Then, the pulse width of the normal driving pulses supplied after the subsequent steps is set at 3.9[ms]. After this, when the pulse width becomes wide enough to rotate the motor again, as shown in FIG. 4*c*, the pulse width of the normal driving pulse is set at 3.4[ms] according to the above-mentioned operation after a few steps of normal driving by the pulse having a width of 3.9[ms].

The foregoing description of the operation according to the present invention relied upon the principle of detecting the angular movement of the rotor, which is an important feature of the present invention, and such will now be explained. Although detecting the angular movement of the rotor can be carried out by using a separate element such as a mechanical switch or a semiconductor, it is very difficult to incorporate such a separate element into a timepiece case which is small in volume, such as the case for an electronic timepiece. Two different detecting principles will now be explained as examples for detecting the angular movement of the rotor, and neither require a separate element so that the detecting circuit can be fabricated on the same IC chip on which the oscillating circuit, frequency dividing circuit, driving circuit, etc. are fabricated.

Figure 5:
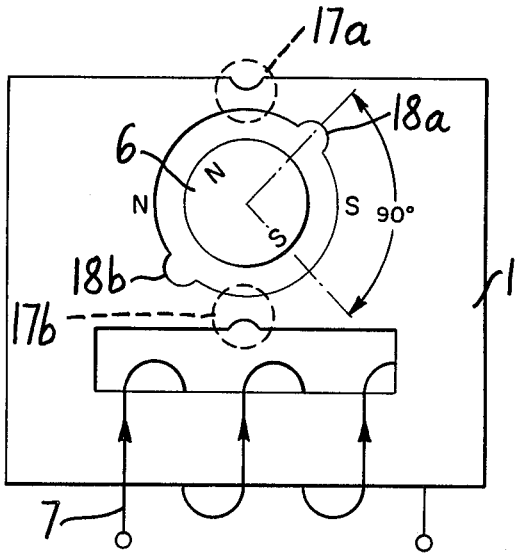
FIGS. 5, 6 and 7 are illustrative diagrams for explaining one operation principle for detecting rotation in the motor.

The first detecting principle utilizes the fact that the waveform of the driving current changes in accordance with the angular position of the rotor, when a one piece stator is used. Referring to FIG. 5, reference numeral 1 represents a stator constructed as one piece or one body and having a rotor opening (not numbered) and saturable magnetic portions The portions 17*a*, 17*b* are magnetically coupled to a magnetic core portion which is wound by a coil 7. A pair of notches or recesses 18*a*, 18*b* are formed in the stator and open into the rotor opening so as to determine the stationary or rest position of the rotor and to determine the rotating direction of the rotor 6 which is magnetized in the radial direction so as to have two poles. FIG. 5 shows the condition just after current is applied to the coil 7. And when current is not applied to the coil, the rotor 6 is stationed at the position shown in FIG. 5 where the angle between the notches 18*a*, 18*b* and the magnetic poles of the rotor is approximately 90°. In this condition, when current flows in the direction of the arrow mark through the coil 7, magnetic poles are generated in the stator as shown in FIG. 5 and the rotor 6 starts to rotate one step in the clockwise direction due to magnetic repulsion. When the current flow through the coil 7 is interrupted, the rotor 6 comes to r-st in the opposite position from that shown in FIG. 5. After this, by flowing the current in the opposite direction through the coil 7, the rotor 6 continues to rotate another step in the clockwise direction.

Figure 3:
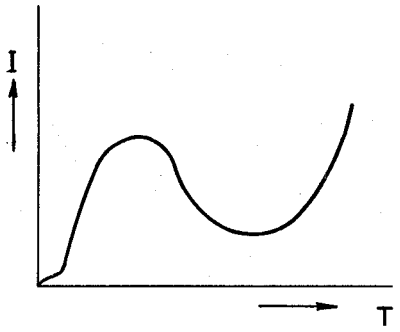
FIG. 3 PRIOR ART
FIG. 3 shows an example of the waveform of the driving current of a prior art timepiece stepping motor.

In the stepping motor provided with the one piece stator having the saturable portions 17*a*, 17*b*, the current has a gradual rising portion as shown by the waveform in FIG. 3 when current begins to blow through the coil 7. This is because the magnetic resistance of the magnetic circuit as viewed from the coil 7 is very low before the saturable portions 17*a*, 17*b* of the stator 1 saturates and as a result, the time constant "$\tau$" of the series circuit of resistor "R" and the coil becomes larger. This can be explained in the following equation.

$$\tau = L/R,\ L \approx N^2/R_m$$

Therefore, $$\tau = N^2/(R \times R_m)$$

in which L: represents the inductance of the coil 7, N: represents the number of turns of the coil 7, and $R_m$: represents the magnetic resistance. When the saturable portions 17*a*, 17*b* of the stator 1 reach saturation, the permeability of the saturated portion is the same as that of the air, so that the magnetic resistance "$R_m$" increases and the time constant "$\tau$" of the circuit becomes smaller as shown by the current waveform in FIG. 3. As a result, the current suddenly rises. Since the saturation time also depends upon the condition of the magnetization of the motor, the saturation time becomes longer in accordance with the increase of the current level in the time when the pulse is cut off. Therefore, since the saturating time becomes long after supplying the correction pulse to the stepping motor, the demagnetizing pulse for cancelling the above-mentioned effect may be supplied to the stepping motor. The angular detection of the movement of the rotor in this example results in the difference of the time constantly of the series circuit of the resistor and the coil. Now, the reason for yielding the difference of the time constantly will be explained in conjunction with the drawings.

Figure 6:
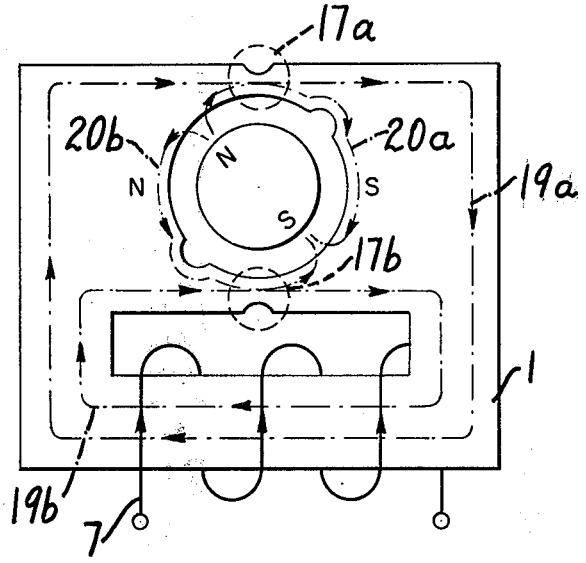
Figure 8:
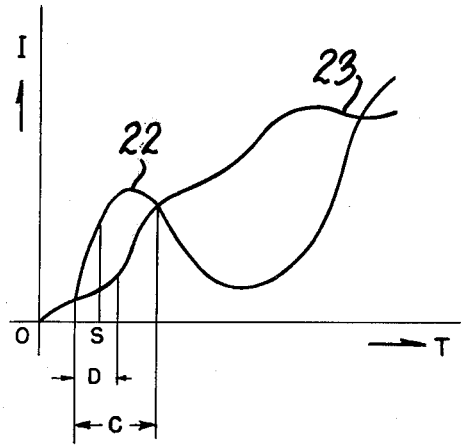
FIG. 8 shows an example of the waveform of the driving current of the stepping motor.

FIG. 6 shows the condition of the magnetic fluxes at the time when the current starts to flow through the coil 7, and the magnetic poles of the rotor 6 are located in the place wherein the rotor 6 can start to rotate. Magnetic flux lines 20*a*, 20*b* shows how the magnetic fluxes are produced from the rotor 6. In practice, there exists a flux which crosses the coil though this is omitted in this case. The magnetic flux lines 20*a* and 20*b* are directed as indicated by the arrow marks shown in FIG. 6. The saturable portions 17*a*, 17*b* 17, in most cases, have not been saturated during this initial period of current flow. In this condition, the current flows through the coil 7 in the direction of the arrow marks so as to rotate the rotor clockwise through one step. The magnetic fluxes 19*a*, 19*b* produced by the coil 7 are strengthened by the fluxes 20*a*, 20*b* produced by the rotor 6 at the saturatable portions 17*a*, 17*b*, so that the saturatable portions 17*a*, 17*b* of the stator will be promptly saturated. After this, the magnetic flux which has a sufficient strength for rotating the rotor 6 is produced in the rotor 6, however, this is omitted in FIG. 6. The waveform of the current which flows through the coil at this time is shown as numeral 22 in FIG. 8.

Figure 7:
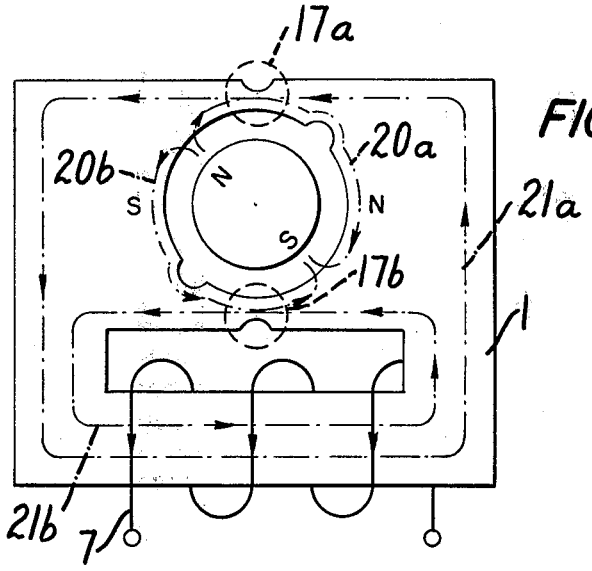

FIG. 7 shows the condition of the flux in which the current has flowed through the coil 7 when the rotor 6 could not rotate for some reason and returned to the original location. In order to effect rotation of the rotor 6, the current must flow through the coil in the opposite direction as shown by the arrow marks, i.e. in the same direction as the current shown in FIG. 6. However, since alternating current is applied, in this case, to the coil 7 once every revolution, the condition such as this will be brought about unless the rotor 6 can rotate. In this case, since the rotor 6 could not be rotated, the direction of the flux produced by the rotor 6 is the same as that shown in FIG. 6. Since the current through the coil 7 flows in the opposite direction, the direction of the flux becomes as shown by the arrow marks 21*a*, 21*b*. The magnetic fluxes produced by the rotor 6 and the coil 7 cancel or multiply each other at the saturatable portions 17*a*, 17*b* of the stator 1. To saturate the saturable of the detecting the stator 1, a much more time is necessary. This condition is shown as numeral 23 in FIG. 8.

An example of a positional detecting means for rotor position utilizing the above-mentioned phenomenon is shown in FIGS. 9 and 10.

FIG. 9 shows one embodiment of a detection circuit for detecting the angular position of the rotor, the circuit being constructed by adding the detection gates 28 and 29, a detection resistor 30, a transmission gate 31 for charging, a capacitor 33 and a voltage comparator 32 to the conventional driving circuit, i.e. a driving inverter composed of MOS gates 24, 25, 26 and 27. First of all, as an example of timing for the normal driving operation, the current flowes through the path 34 whereby the coil 7 is energized and the rotor is driven one step. After the rotor has substantially finished its stepwise movement, a first detecting pulse is applied to the coil 7 through a path 35 for a short time (about 0.5[ms] to 1[ms]) and, after that, a second detecting pulse is applied to the coil 7 through a path 36.

Now, asumming that the normal driving pulse makes the rotor normally rotate by one step, the relation between the magnetic poles of the rotor and the magnetic poles of the stator at the time when the first detecting pulse is applied to the coil has been the condition that the rotor can be driven by one step again as shown in FIG. 6. The rising portion of the current shape at this time represents a waveform with a steep rising time as shown by numeral 22 of FIG. 8. When the second detecting pulse is applied to the coil, the rotor is the same position as in the case of the first detection pulse (wherein the pulse width of the detection pulse is short and the resistor 30 having a large resistance is connected to the coil in series, the rotor can not rotate by applying the detecting pulse thereto). Since the directions of excitation are opposite respectively, the positional relation between the magnetic poles of the rotor and the magnetic poles of the stator are as shown in FIG. 7 and the rising portion of the current shape has a gradual rising time as shown by the waveform indicated by numeral 23 in FIG. 8. However, since the detection resistor 30 is connected to the coil in series at the time of applying the detection pulse, this shape does not coincide precisely with the shape in FIG. 8 except for the feature in the rising portion.

Then, the fact that the potential $V_{s1}$ produced by the first detection pulse rises to a much higher potential than the potential $V_{s2}$ produced by the second detection pulse, as shown in FIG. 10*a*, will be seen by observing the voltage across the detection resistor 30.

When the rotor is not rotated one step of rotation by the application of the normal driving pulse, the rotor turns back to the original location and the position relation between the magnetic poles of the rotor and the magnetic poles of the stator at the time of the application of the first detection pulse and the second detection pulse becomes the opposite with respect to the relation at the time of the normal rotation. Therefore, in the voltage developed across the detection resistor 30, the potential $V_{s2}$ will be larger than the potential $V_{s1}$, as shown in FIG. 10*b*.

Therefore, it will be understood that it is possible to detect whether the rotor has performed a normal step movement by the application of the normal driving pulse by comparing the value of $V_{s1}$ with the value of $V_{s2}$. In this embodiment, the voltage difference between $V_{s1}$ and $V_{s2}$ is about 0.4 V. Such a degree of the value of the potential can be easily detected. To carry out the detecting operation described above, for example, the circuit constructed as shown in FIG. 9 may be used, wherein the gate 31 is to be in an ON condition at the time of the first detecting pulse so that the capacitor 33 is charged by $V_{s1}$, and then, the potential $V_{s1}$ charged to the capacitor 33 at the time of the application of the second detecting pulse is compared with the potential $V_{s2}$ produced across the terminals of the detection resistor 30 in voltage comparator 33 to decide which potential is larger.

In the foregoing, the explanation of the first method of the principle for detecting the step movement of the rotor has been finished. In the foregoing, the principle for detecting the movement of the rotor, in which the voltage waveform produced in the coil by the free oscillation of the rotor after driving the rotor, will be explained as follows:

FIG. 11(*a*) shows the time relation between the produced voltage waveform of the coil and the rotary angle $\theta$ of the rotor, the voltage waveform being developed across the terminals of the resistor having a high resistance, such as a resistance of several 10 [KΩ], when the resistor having a high resistance is connected to both terminals of the coil after applying the driving pulse to the coil. FIG. 11(*b*) shows the rotary angle $\theta$ which is the angle formed between the horizontal axis of the stator and one of the rotor poles, in this case the N pole.

A section "$T_1$" is the time during which the driving pulse is applied to the coil, with the resistor having a high resistance (the detection resistor) not connected to the circuit and therefore the produced voltage waveform does not appear. The voltage in section "$T_2$" is the voltage which is produced in the coil by the rotational and vibrational movement of the rotor after being driven. Since the voltage waveform in the section "$T_2$" changes in response to the load condition and the driving condition of the stepping motor, the detection of the changes of the voltage waveform during section $T_2$ makes it possible to detect the movement of the stepping motor.

Figure 12:
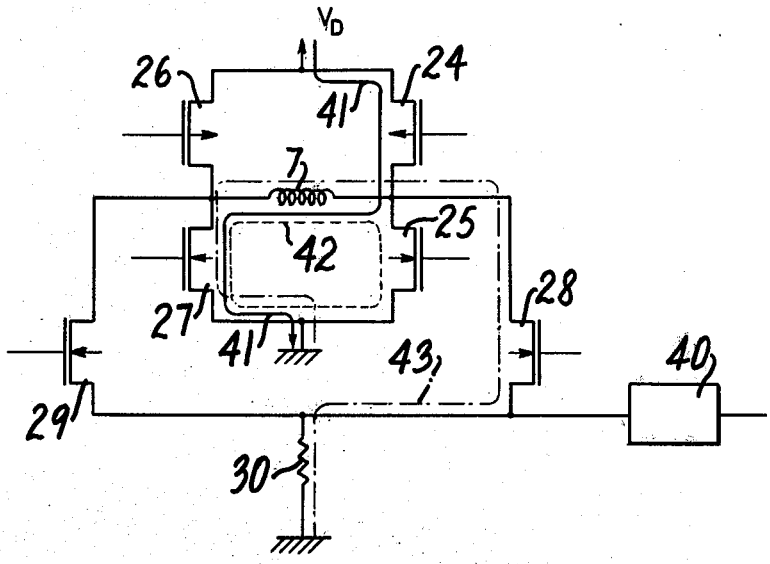
FIG. 12 is an example of a movement detection circuit for a rotor according to another principle.

FIG. 12 shows an example of the detection circuit according to this principle. The gates 24, 25 26, 27, 28 and 29, the detection resistor 30 and the coil 7 are constructed in the same manner as the construction shown in FIG. 9, but the input signal in FIG. 12 differs from the input signal in FIG. 9. The conjunction point of the detection resistor 30 is connected to an input terminal of a voltage detector 40 with a predetermined threshold level. When the normal driving pulse is applied to the coil through the path 41 and the coil is energized, the rotor is driven. After that, during the movement of the rotor, switching action is intermittently accomplished between the condition wherein both terminals of the coil are grounded through a path 42 to make a short circuit condition, and the condition wherein a closed loop including the detection resistor 30 having a high value of resistance is formed. The effect of the intermittent switching action will be explained later. At first, to simplify the explanation, the condition wherein the closed loop including the detection resistor 30 is formed at the time when the rotor has just driven will be explained. FIG. 11*a* shows the waveform of the voltage produced across the detection resistor 30 in such a condition. In FIG. 11*a*, the stepping motor is approximately in a no load condition. FIG. 13(*a*) shows the time relation between the produced voltage waveforms at the maximum load condition (curve "a") and the over-load condition (curve "b") and the rotary angle $\theta$ of the rotor while FIG. 13(*b*) shows the rotary angle $\theta$ which is the angle formed between the horizontal axis of the stator and one of the rotor poles, in this case the N pole. Since the rotational speed of the rotor in the maximum load condition "a" is slow and the magnitude of the vibration thereof after the revolution of one step is small, the waveform of the produced voltage has less irregularity. In the over-load condition "b", the peak voltage is produced in the negative direction when the rotor returns back to the original position. However, the waveform of the produced voltage has in generally less undulations except for the above-mentioned portion.

Although there are many method for detecting whether the rotor was rotated, by use of the waveform of the produced voltage, of the rotor when the method in which the condition of the rotor is detected by detecting the existance of the peak wave-form "P" is employed, the circuit can be simplified and the condition of the rotor can be surely detected. That is, the condition of rotation or nonrotation is determined on the basis of whether the terminal potential at the detection resistor 30 reaches above a predetermined potential within the predetermined time which is supposed to produce the peak "P" after the termination of a few milliseconds of the application of the drive pulse.

Figure 13A:
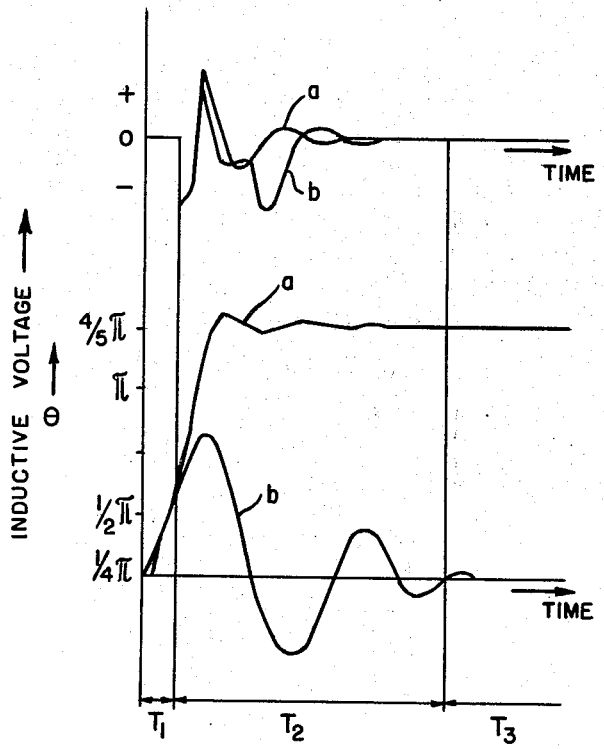
Figure 13B:
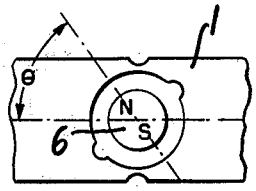

According to this method, however, the rotor is considered to be in a non-rotating condition despite the fact that the rotor rotates in a condition of maximum load as shown in FIG. 13*a*. In this condition such an error operation is in a safety side when this principle is utilized in the correction driving system such as the present invention. Furthermore, in this case, since the correction pulse having the same polarity is merely excessively produced, no over-rotating operation of the rotor ever occurs.

Figure 14:
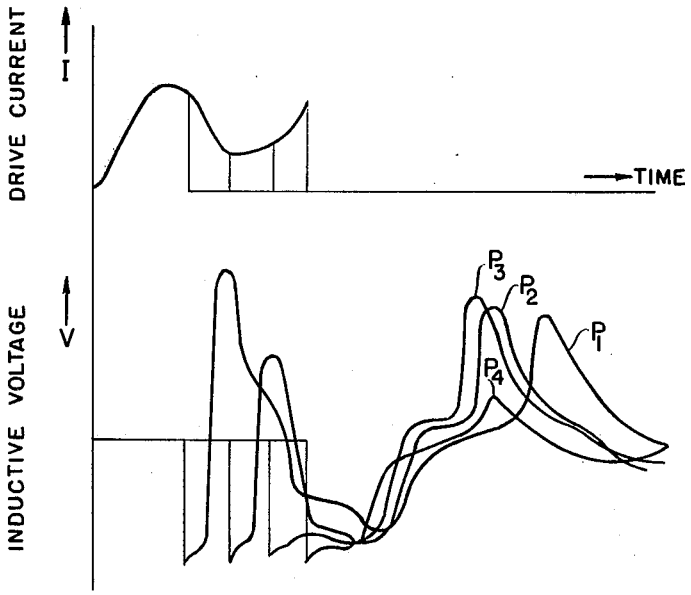
FIG. 14 shows a induced voltage waveform and a current waveform at the time when the pulse width of a driving pulse is varied.
Figure 15:
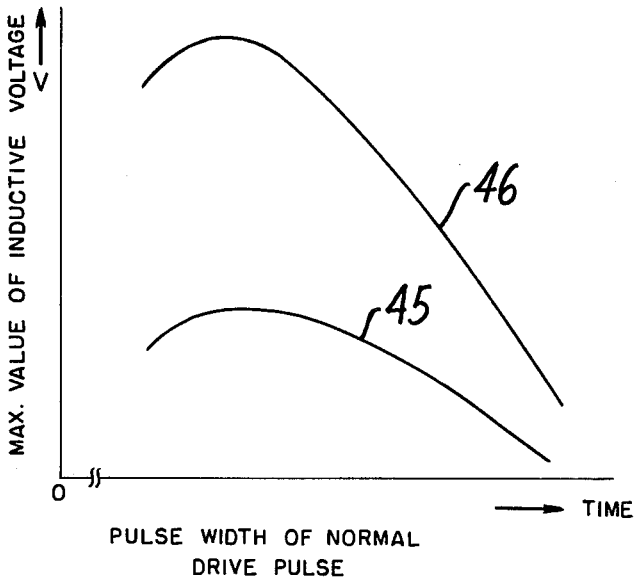
FIG. 15 is a graph showing the relation between the pulse width of a driving pulse and the peak potential of an induced voltage after this.

FIG. 14 shows the waveforms of the produced voltage in the coil after driving with the application of the normal driving pulses having various pulse widths. It can be seen from this figure that when the pulse width of the normal drivng pulse becomes longer than a predetermined width, the peak value, in the produced voltage waveform, becomes lower as shown by "$P_4$", in spite of being in the condition of a no-load and a normal rotation. To explain face plainly FIG. 15 is shown in which the axis of the abscissa represents the pulse width of the normal driving pulse and, the axis of the ordinate represents the peak voltage of the produced voltage. Numeral reference 45 represents the curve during the condition wherein the closed loop is formed by continuously connecting the detection resistor to the coil in series after driving as described hereinbefore, and numeral reference 46 represents the curve during the condition wherein the detection resistor is intermittently connected in the closed loop as described hereinafter.

Figure 1:
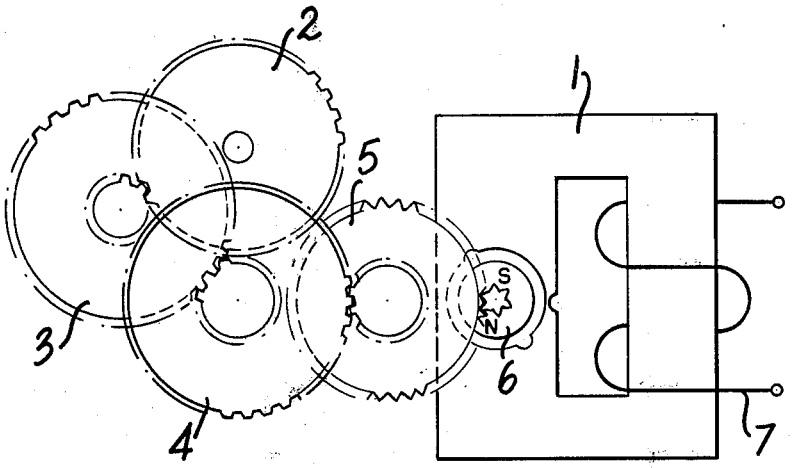
FIG. 1 PRIOR ART
FIG. 1 shows an example of a prior art display mechanism for a general analog display type electronic timepiece.
Figure 2:
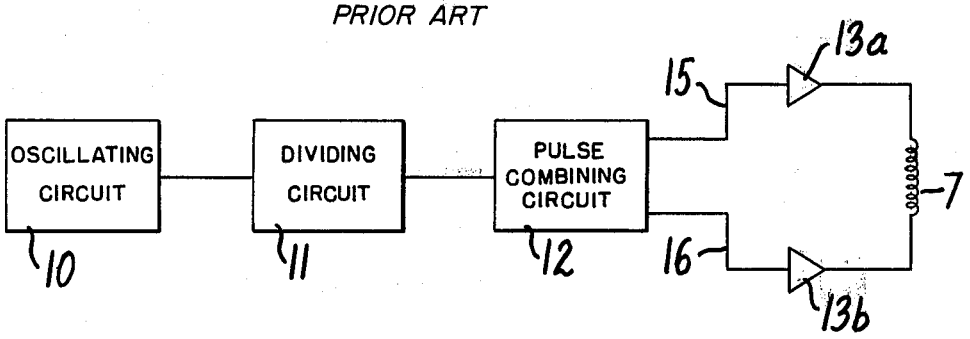
FIG. 2 PRIOR ART
FIG. 2 shows an example of a prior art circuit construction of a conventional electronic timepiece.

Now, the effect obtained by continuously connecting the detection resistor to the coil in series after the application of the driving pulse will be explained. In the conventional driving circuit as shown in FIG. 2, to carry out the driving operation by the use of two inverters, both terminals of the motor are shorted by the use of the resistor having low resistance in the driver constructing the inverter when the motor is in the non-operating condition. Therefore, the current flow by the voltage developed in the coil flows into the short-circuit of the path 42 in FIG. 12. The current causes Joule heat in the resistor and the transistor for driving and as a result of this, the rotor is damped. When the closed loop is formed by means of the path 43 shown in FIG. 12 in order to detect the produced voltage, since the detection resistor 30 having a high impedance in addition to the driving circuit is connected in series, the current flowing through the damping circuit is small compared with the former.

Then, switching action between the two circuits at the time of the braking operation for the rotor causes the prompt change of the current in the circuit. However, since the inductance of the coil of the motor is large, the circuit can not follow in response to the change of current. As a result, the circuit shows the response characteristics of a first-delay having the time constant "$\tau = L/R$", which depends on the inductance "L" of the coil and the resistance $Rd = (R + R_{30})$ of the braking circuit. The value of the voltage produced across the detection resistor 30 at this time is approximately zero volts when the braking circuit is constructed by use of the path 42 as shown in FIG. 12, and at the moment of switching to the path 43, the coil 7 operates so as to maintain the flow of the current at the braking operation through the path 42. As a result, a high value of voltage is instantaneously developed across the detection resistor 30 having high impedance. After this, this high value of voltage is reduced in accordance with the time constant "$\tau$".

Figure 16:
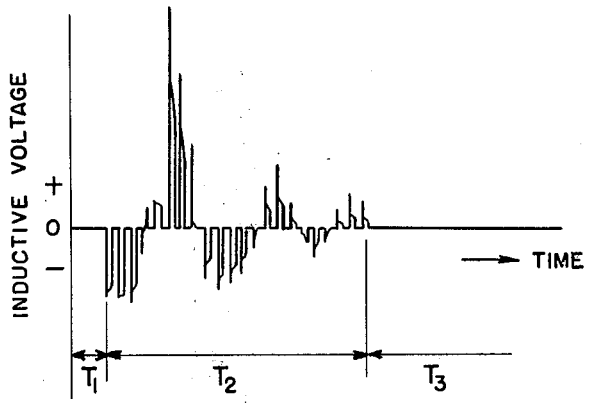
FIG. 16 shows an example of a waveform of an induced voltage at the time when the movement of a rotor is detected.

FIG. 16 shows an example of the waveform of the voltage produced across the detection resistor 30 at this time. It is a feature of this method that amplifying the voltage produced by the motor at the time of the braking action is possible by only changing the value of the resistor in the circuit for braking the rotor, and that the maximum value of the peak voltage reaches the value beyond the voltage value (about 1.5 V) of the power supply of the driving circuit when the detection resistor is intermittently connected as shown by reference curve 46, whereas the maximum value of the peak voltage is about 0.8 [V] at most when the produced voltage is continuously detected as shown by reference curve 45 in FIG. 15. Consequently, it is very easy to detect such a voltage. Now, as seen from FIG. 15, it should be noted that when the pulse width of the normal driving pulse is increased to some degree, the undulations of the produced voltage become to detect.

The two types of principles of the detecting circuit for the stepped movement of a rotor have been described, however, the feature of the present invention is essentially in that the pulse width of the normal driving pulse is increased or decreased. Therefore, although the construction of the stepping motor and the detecting circuit for detecting the movement of the stepping motor are important elements, they are not limited to the embodiments described in this specification.

Now, an embodiment of the present invention will be explained hereinafter.

Figure 17:
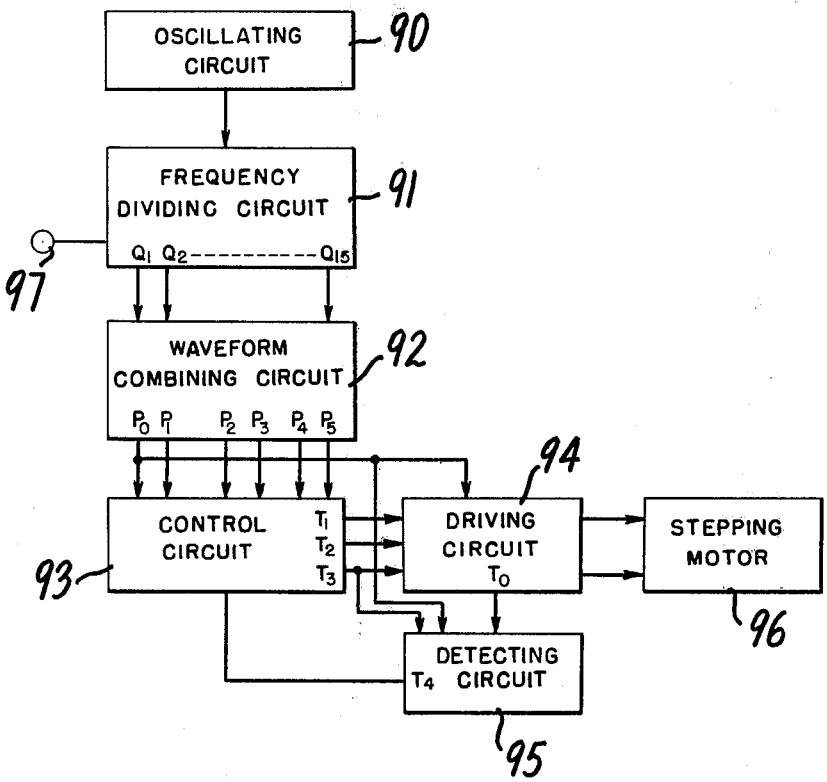
FIG. 17 is a block diagram of an embodiment according to the present invention.

FIG. 17 shows a block diagram of an embodiment of the present invention.

Numeral reference 90 represents an oscillating circuit, in which a quartz vibrator having a vibrating frequency of 32,768 [Hz] is normally used. Numeral reference 91 is a frequency dividing circuit which consists of fifteen cascaded flip-flops whereby thereby the timing signal of 1-second is obtained by the frequency dividing circuit.

Figure 18:
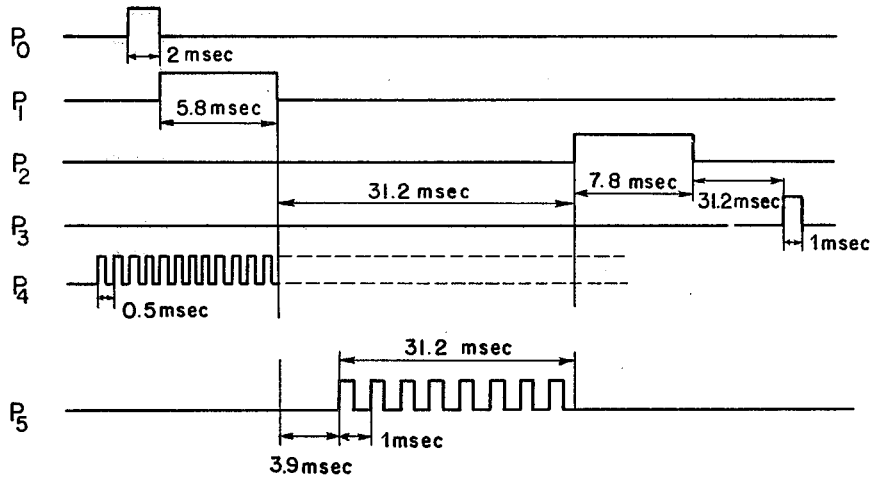
FIG. 18 is a timing chart of the pulse required for the embodiment of FIG. 17.

Reference 97 is a reset-input of the watch, and all of the frequency dividing stages are reset by the application of the reset input. Reference 92 is a waveform combining circuit in which desired pulses are obtained from the combination of output signals of the flip-flops of the frequency dividing circuit 91 using NAND gates and NOR gates, as shown in the timing chart in FIG. 18. Since the waveform-combining circuit can be easily designed by using logic circuits, the schematic diagram thereof is omitted.

Figure 19:
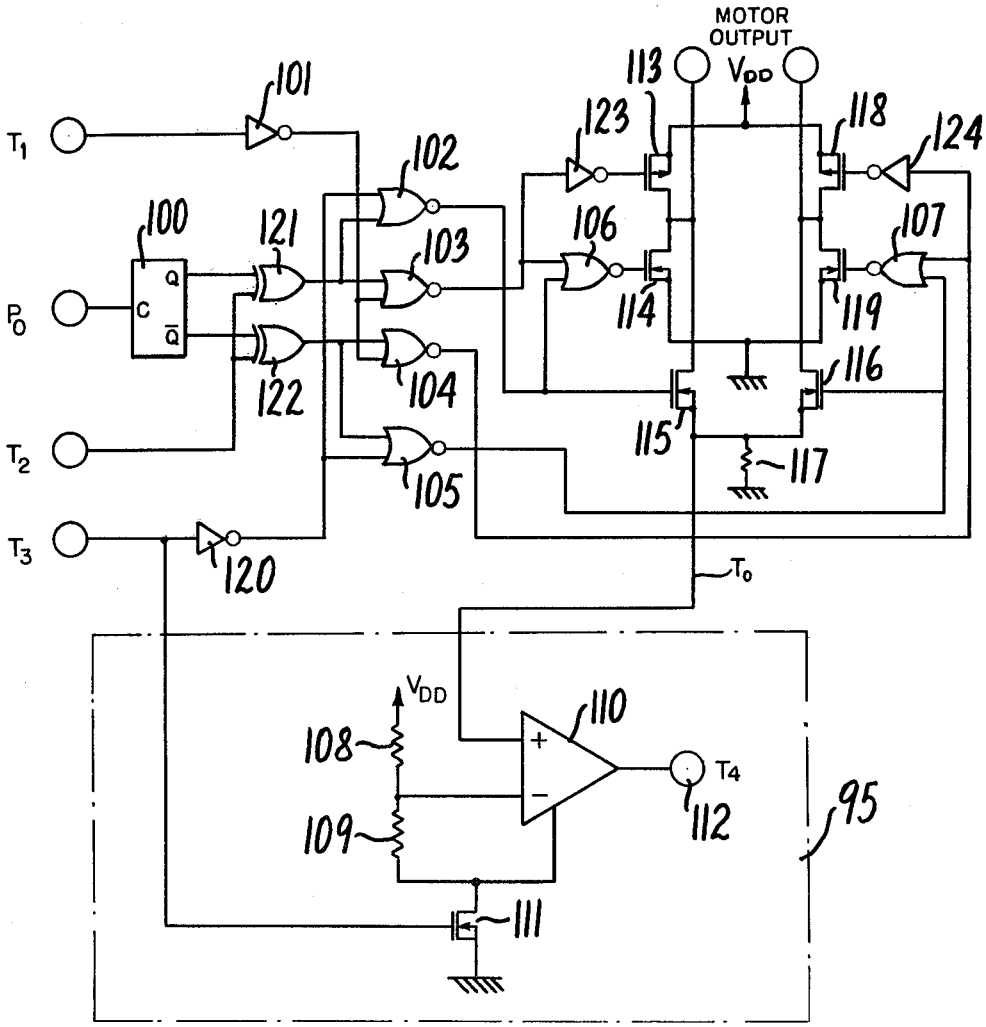
FIG. 19 shows an embodiment of a driving circuit and a detecting circuit.

FIG. 19 shows circuit diagrams of a driving circuit 94 and a detecting circuit 95 shown in FIG. 17 and, an input terminal "$T_1$" is an output terminal of a control circuit 93 shown in FIG. 17. Only when the terminal "$T_1$" is "H", is one output terminal to stepping motor 96 "H" and the other terminal to the stepping motor "L" and as a result, a current flows into the stepping motor 96. The output signal from the control circuit 93 shown in FIG. 11*a* is applied to a terminal "$T_2$". Signals Q and $\overline{Q}$ of a flip-flop 100 are applied to Ex-OR gate 121,122 during the period, $T_2$ and the output of the Ex-OR gates 121,122 are logically inverted against the output of the flip-flop 100 when $T_2$ becomes H. As a result, it is possible to invert the direction of the current flowing through the motor.

In this embodiment, the motor is driven by utilizing the correction pulse "$P_2$" when the rotor can not be rotated by the application of the normal driving pulse, and the pulse "$P_3$", which is opposite to the pulse "$P_2$", is subsequently applied again. This is because, in the motor of the one piece stator type, the magnetic saturation time of the saturable magnetic path in the one piece stator at the time of the application of the next driving pulse becomes longer when the correction driving operation is carried out by using the pulse "$P_2$" as well as the effective pulse width is reduced. From this reason, as the opposite pulse "$P_3$" is applied to the coil of the stepping motor 96 when the correction driving operation is carried out by the application of the pulse "$P_2$", the stator is magnetized in the direction according to the direction of the next driving pulse, and then, the time required for a saturation of the narrow portion of said one piece stator can be reduced.

The output "$T_3$" of the control circuit 93 shown in FIG. 17 is applied to an input terminal "$T_3$", and the operation for detecting the rotating condition is carried out by using this pulse in accordance with the above-mentioned method in which the voltage produced after the rotation of the rotor is utilized.

When the pulse "$P_0$" having a period of 1-second is applied to the flip-flop (which will be referred to as F/F, hereinafter) 100, the F/F 100 develops the signal having a frequency of $\frac{1}{2}$ [Hz], the output "Q" is applied to a Ex-OR gate 121 and, the output "$\overline{Q}$" is applied to a Ex-OR gate 122. To another input terminal of each of Ex-OR gates 121 and 122, the output "$T_2$" is applied. The output of the Ex-OR gate 121 is connected to NOR gates 102 and 103, and the output of the Ex-OR gate 122 is connected to NOR gates 104 and 105.

The output signal of inverter 101 is applied to NOR gates 103 and 104. The output "$T_3$" of the control circuit 93 is applied to NOR gates 102 and 105 through inverter 120.

The output of the NOR gate 102 is connected to the gate of an first input terminal of a NOR gate 106 and to a N-type MOS FET 115.

The output of the NOR gate 103 is connected to the gate of a P-type MOS FET 113 using for driving the stepping motor through inverter 123 and to a second input terminal of the NOR gate 106.

The output of the NOR gate 104 is connected to the gate of a P-type MOS FET 118 using for driving the stepping motor through a inverter 124 and to a first input of a NOR gate 107. The output of a NOR gate 105 is connected to the gate of an N-type MOS FET 116 and to a second input of the NOR gate 107. The output of the NOR gate 106 is connected to the gate of an N-type MOS FET 114 for driving the stepping motor and the NOR gate 107 is connected to the gate of an N-type MOS FET 119 for driving the stepping motor.

A power supply terminal $V_{DD}$ is a power input terminal of positive polarity, and to which the source electrodes of P-type MOS FETs 113 and 118 are connected.

The source electrodes of the N-type MOS FETs 114 and 119 are grounded, the drain electrodes of the P-type MOS FET 113 and the N-type MOS FET 114 are connected to each other. These drain electrodes are connected to one output terminal of the coil of the stepping motor 96 and to the drain electrode of the N-type MOS FET 115 for detection.

The drain electrodes of the P-type MOS FET 118 and the N-type MOS FET 119 are connected to each other, and furthermore, these drain electrodes are connected to the other output terminal of the coil of the stepping motor 96 and the drain electrode of the N-type MOS FET 116.

The source electrodes of the N-type MOS FETs 115 and 116 are connected to each other and, the conjunction point is connected to one side of a resistor 117. The other side of the resistor 117 is grounded.

The conjunction point of the N-type MOS FETs 115, 116 and resistor 117 is connected to the positive input terminal of a comparator 110.

The signal appearing at the conjunction point, $T_0$, is the signal showing whether the rotor has rotated or not, and the circuit comprising of the resistors 108, 109, the comparator 110 and the N-type MOS FET 111 is an embodiment of the detecting circuit 95. If the detection signal $T_0$ can be detected by utilizing the threshold voltage of a CMOS gate circuit, a CMOS inverter may be used in lieu of the comparator 110.

One side of the resistor 108 is connected to the power source $V_{DD}$, and the other side of the resistor 108 is connected to the resistor 109. In this case this conjunction point is connected to the negative input terminal of the comparator 110. The other side of the resistor 109 is connected to the drain electrode of the N-type MOS FET 111 for the inhibitation of the detecting operation and, it is grounded through the source electrode. The ground terminal of the comparator 110 is also connected to the drain electrode of the N-type MOS FET 111 and it is grounded through the source electrode.

The output signal from the comparator 110 is produced at a terminal 112 as a signal $T_4$ and it is applied to the control circuit 93 as shown in FIG. 17.

The comparator used in the detecting circuit 95 according to the present invention is constructed by using CMOS and, it's operation will be briefly explained hereinafter.

Figure 20A:
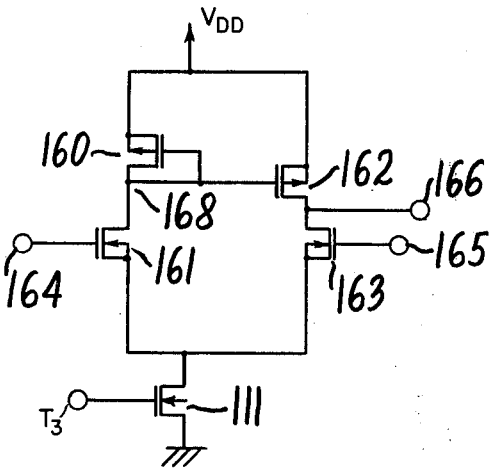
FIGS. 20*a* and 20*b* are a detailed constructional diagram and a block diagram of a comparator.
Figure 20B:
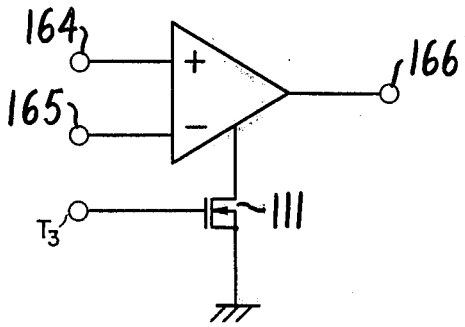

FIG. 20 shows an embodiment of the comparator 110, wherein FIG. 20(*a*) is a detailed explanation view and FIG. 20(*b*) is a block diagram.

Terminal 164 is the "+" input terminal, terminal 165 is the "−" input terminal, terminal 166 is the output terminal and terminal $T_3$ is the enable terminal of the comparator.

Their functions as shown in Table-1.

TABLE 1

| "+" input terminal | "−" input terminal | enable terminal | output terminal |
|---|---|---|---|
| — | — | 0 | — |
| $V_+ > V_-$ | | 1 | "H" |
| $V_+ < V_-$ | | 1 | "L" |

Reference "$V_{DD}$" represents a terminal for a power supply, and the terminal is connected to the source electrodes of the P-type MOS FETs 160 and 162.

In the P-type MOS FET 160, the gate electrode is connected to the drain electrode and, the conjunction point is connected to the gate electrode of the N-type MOS FET 162 and to the drain electrode of the P-type MOS FET 161. The gate electrode of the N-type MOS FET 161 is connected to a terminal 164, and the source electrode thereof is connected to the drain electrode of N-type MOS FET 111.

The drain electrode of the P-type MOS FET 162 is connected to the drain electrode of a N-type MOS FET 163 and to the output terminal 166 thereof.

The gate electrode of the N-type MOS FET 163 is connected to the terminal 165 and, the source electrode of the MOS FET 163 is connected to the drain electrode of the N-type MOS FET 111 together with the source electrode of the N-type MOS FET 161.

In the N-type MOS FET 111, the source electrode is grounded and the gate electrode is connected to the terminal $T_3$.

In addition, the electrical characteristics of the N-type MOS FET 161 are identical to that of the N-type MOS FET 163, and, the electrical characteristics of the P-type MOS FET 160 are identical to that of the P-type MOS FET 162.

With respect to the comparator constructed as described above, the operation will be explained. When the enable terminal $T_3$ is "L", the N-type MOS FET 111 is turned off, and the comparator can not be operated.

When the terminal $T_3$ becomes "H", the N-type MOS FET 111 is turned ON, and the comparator is in an operable condition. Since, in this embodiment, the threshold voltage for the detection signal is obtained by the divided voltage in the circuit comprising of the resistors 108 and 108 only when the current is always flowing through the circuit, the power will be wasted. Thus, in this embodiment, the circuit is designed in such a manner that the current can be flowing only when the pulse $T_3$ becomes "H" due to the operation of the N-type MOS FET 111. As a result of this, one is able to realize a small current and thereby a small power consumption.

Figure 21A:
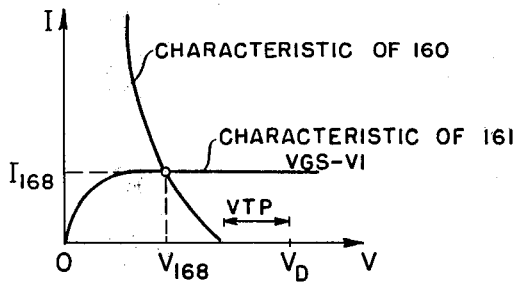
FIGS. 21*a* and 21*b* are characteristic curves for a comparator.
Figure 21B:
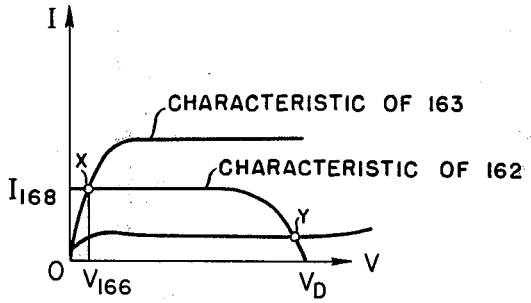

When an input voltage $V_1$ is applied to the terminal 164, the potential and the current appearing at the conjunction point 168 is shown in FIG. 21(*a*).

In FIG. 21*a*, $V_{168}$ is the potential at the terminal 168, and $I_{168}$ is the current flowing through the terminal 168.

Since the potential $V_{168}$ is applied to the gate electrode of the P-type MOS FET 162, the saturation current thereof is equal to the current $I_{168}$.

This condition is shown by the characteristic 162 in FIG. 21(*b*).

On the other hand, assuming that the voltage applied to the terminal 165 is $V_2$, the saturation current of the N-type MOS FET 163 becomes larger than $I_{168}$ when $V_2$ is larger than $V_1$.

Consequently, the potential $V_{166}$ at the output terminal 166 becomes approximately the "L" level.

This condition is shown by an operational point "X" in FIG. 21(*b*).

On the contrary, when "$V_1$" is larger than "$V_2$", the output "$V_{166}$" becomes the "H" level. This condition is shown by reference point "Y" in FIG. 21(*b*).

Therefore, the functions of the circuit can be explained as shown in Table-1.

Figure 22:
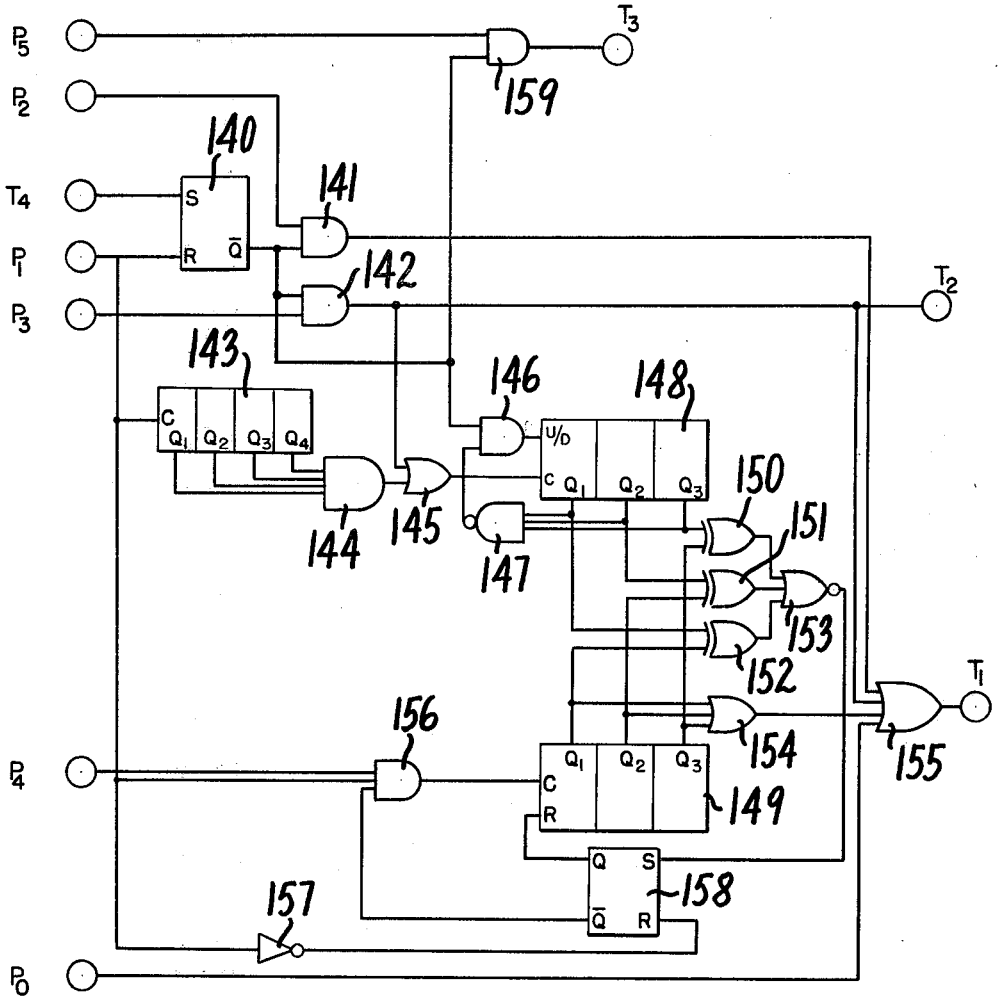
FIG. 22 is a example of a construction of a control circuit.

FIG. 22 shows an example of the circuit of the control circuitry 93 shown in FIG. 17.

The output signal "$T_4$" from the detecting circuit 95 is applied to the set-input terminal "S" of a SR-F/F 140. The signal $P_1$ from the waveform combining circuit 92 is applied to reset terminal "R" of a SR-F/F 158 through the inverter 157, a clock input terminal C of a binary counter 143 and an input terminal of an AND gate 156. To AND gate 141, the output signal "$P_2$" of the waveform combining circuit 92 and the $\overline{Q}$ output of SR-F/F 140 is applied. To AND gate 142, the output $P_3$ from the waveform combining circuit 92 and the $\overline{Q}$ output of the SR-F/F 140 is applied and the output signal thereof is applied to a driving circuit as "$T_2$". To AND gate 159, the output "$P_5$" from the waveform combining circuit 92 and the Q output of the SR-F/F 140 are applied and the output signal "$T_3$" therefrom is applied to the driving circuit 94.

In this embodiment, the binary counter 143 consists of four stages of flip-flops, the output signal $Q_1$–$Q_4$ from each stage is applied to the AND gate 144. To OR gate 145, there are applied the output of the AND gate 144 and the output of the AND gate 142. To AND gate 146, there are applied the $\overline{Q}$ output from the SR-F/F 140 and the output of NAND gate 147. In up/down counter 148, the output of the AND gate 146 is applied to an U/D input (up/down control input) and the output of the OR gate 145 is applied to a clock input "C". In this embodiment, the up/down counter 148 has three stages of flip-flops, the outputs $Q_1$, $Q_2$ and $Q_3$ are respectively applied to the NAND gate 147, and each of the outputs "$Q_1$", "$Q_2$" and "$Q_3$" are applied to the Ex-OR gates 152, 151 and 150, respectively. The outputs $P_1$ and $P_4$ of the waveform combining circuit 92 and the $\overline{Q}$ output of the SR-F/F 158 are applied to AND gate 156. In binary counter 149, the output of AND gate 156 is applied to the clock input "C", and the "Q" output of the RS-F/F 158 is applied to the reset input "R" of counter 149. In this embodiment, the binary counter 149 consists of three stages of flip-flops, each of outputs $Q_1$, $Q_2$ and $Q_3$ are respectively applied to inputs of OR gate 154, and each of outputs $Q_1$, $Q_2$ and $Q_3$ are applied to Ex-OR gates 152, 151 and 150, respectively. The outputs of the Ex-OR gates 150, 151 and 152 are applied to the inputs of NOR gate 153 and the output of the gate 153 is applied to the NOR set input "S" of the SR-F/F 158. The output of the AND gate 141, the output of the AND gate 142, the output of the OR gate 154 and the output "$P_0$" of the waveform combining circuit 92 are respectively applied to OR gate 155, and the output "$T_1$" thereof is applied to the driving circuit.

The operation of the embodiment will hereinafter be explained.

Since the SR-F/F 140 is in the set condition by the application of the detection signal "$T_4$" when the rotor was rotated and then the $\overline{Q}$ output becomes "L", all of the outputs of the AND gates 141, 142, 146 and 159 become "L". As a results of this, the output "$T_3$" of the AND gate 159 becomes "L" at the moment when the normally rotated condition is detected, and after this, the detection circuit is in an inhibit condition. Since the up/down counter 148 can be operated as an up counter when the U/D input is "H" and the up/down counter 148 can be operated as a down counter when the U/D input is "L", the counter 148 acts as a down counter when the rotor is normally rotated.

At this time, since the output "$P_1$" from the waveform combining circuit is applied to the clock input "C" of the binary counter 143 once every second, in the case of the binary counter 143 consisting of four stages of flip-flops, such as in this embodiment, the output of the AND gate 144 becomes "H" every sixteen seconds. This output is applied to the clock input "C" of the up/down counter 148 through the "OR" gate 145, and the counting contents in the up/down counter 148 is reduced by 1 every sixteen seconds.

On the other hand, since the output $P_4$ of the waveform combining circuit 92 is a signal with a frequency of 2048[Hz], the period of the output is about 0.5[ms], and the output is applied to the clock input "C" of the binary counter 149 through the AND gate 156 only when the output "$P_1$" of the waveform combining circuit 92 is "H". In this embodiment, the binary counter 149 consists of three stages of flip-flops. The Ex-OR gates 150, 151 and 152 always check whether the output of the binary counter 149 is coincident with the output of the up/down counter 148 and, when both of the outputs coincide in the valve, all of the outputs of the Ex-OR gates 150–152 become "L" and the output of the NOR gate 153 becomes "H". Therefore, the SR-F/F 158 is set, the "Q" output becomes "H" and the binary counter 149 is reset. As a result of this, the output of the "OR" gate 154 becomes "H" and the time width of the output $T_1$ is equal to the value of the product of the number of counts in the up/down counter 148 and time of 0.5[ms].

On the other hand, in the case wherein the output $T_4$ of the detecting circuit 95 does not produce any signal that is "H" within the time for detection, it is understood that the rotor could not be rotated by the application of the first normal driving pulse, and the $\overline{Q}$ output of the SR-F/F 140 remains in the "H" condition. As a result, the output $P_2$ from the waveform combining circuit 92 is produced from the output of the OR gate 155 intact, and the output of the OR gate 155 permits the motor to carry out the correction drive. The output "$P_3$" of the waveform combining circuit 92 is derived from the output of the AND gate 142 as the signal "$T_2$", and the signal "$T_2$" is applied to the driving circuit 94. At this time, since the circuit 94 controls the current direction in such a way that the current flow in the direction which is opposite to the direction of the current flowing through the coil of the motor in the condition of the correction driving, and at the same time the signal from the output "$T_1$" of the OR gate 155 is applied to the driving circuit 94, the effects according to the residual magnetism in the stepping motor can be eliminated. Therefore, the elimination of the saturation time for the saturable magnetic path can be carried out. Moreover, since the "$\overline{Q}$" output of the RS-F/F 140 is "H", the output of the AND gate 146 becomes "H" and the U/D input of the up/down counter 148 becomes "H". The up/down counter is therefore set in the up counting mode, and the output "$P_3$" of the waveform combining circuit 92 is applied to the clock input "C" of the up/down counter 148 through the AND gate 142 and the OR gate 145. As a result, the counting contents in the up/down counter 148 is incremented by one, and the length of the driving pulse produced in the next time interval becomes longer by 0.5[ms]. All the outputs $Q_1$, $Q_2$ and $Q_3$ of the flip-flops in the up/down counter 148 become "H" upon further incrementation and the situation occurs wherein the contents in the counter could become all "L" at the time of the application of the next up input. To inhibit this condition, the output of the AND gate 146 becomes "H" when all the inputs of the NAND gate 147 become "H", and the up/down counter 148 is then operated as a down counter. As a result, the condition that the contents of the counter 148 becomes all "L" is inhibited.

It is the role of the output "$P_0$" of the waveform combining circuit to decide the minimum pulse width of the normal driving pulse. This is because a great deal of energy is lost until the condition is reached wherein the motor is driven by a pulse having a constant width, if the pulse width increases from 0[ms] of a pulse width. In this embodiment, the minimum pulse width of the driving pulse is set at about 1.9[ms].

The counting contents of the up/down counter 148 are not reset even if the frequency dividing circuit 91 is reset and, the change in the pulse width of the driving pulse is started from the value of the pulse width before the reset operation even if the reset condition is released.

When the pulse width of the driving pulse for the stepping motor is too short for rotating the stepping motor, it is impossible to rotate the stepping motor by the pulse width of the normal driving pulse. Therefore, since the output signal "$T_4$" from the detecting circuit is "L", the $\overline{Q}$ output of the SR-F/F 140 becomes "H" and the output signal $P_2$ from the waveform combining circuit 92 is applied to the stepping motor 96 as the correction driving pulse. The pulse width of the signal is set in order that the maximum torque of the stepping motor is assured. In this embodiment, this width is set at 7.8[ms]. Since the up/down counter 148 acts as an up counter when the output $P_3$ of the waveform combining circuit 92 is applied, the counting contents are incremented by 1. Therefore, if the pulse width of the driving pulse produced after one second is 1.9[ms], the pulse width of the normal driving pulse developed after two seconds becomes equal to the total pulse width of the output "$T_1$"=1.9[ms] from the waveform combining circuit and 0.5[ms]. That is, it becomes a driving pulse having a width of 2.4[ms]. In addition, if the motor can not be rotated by the application of the pulse having such a pulse width, the motor is further driven by the correction driving pulse having a width of 7.8[ms].

A pulse width of 7.9 msec is a substantial pulse width for safely driving a stepping motor when the load of a gear train becomes larger due to the calendar load of the timepiece, a timepiece being located in a magnetic field, the internal resistance of a battery becomes higher due to a low temperature or the battery voltage becomes lower at the end of the battery life.

After this, the counting contents of the up/down counter is set at 2 by the output "$T_3$" of the waveform combining circuit 92. Thus, the length of the normal driving pulse developed after three seconds becomes 2.9[ms]. If the motor can not be rotated by the application of the pulse having such a width, the same operation described above is repeated, and as a result, the motor can be rotated by the normal driving pulse which has the minimum pulse width for rotating the rotor. However, when the counting contents of the binary counter 143 becomes 16, the output of the AND gate 144 becomes "H" and, the contents of the up/down counter 148 are decremented by one. As a result, if the normal driving operation is being carried out by using a pulse having a width of 3.4[ms], the next normal driving pulse becomes a pulse having a width of 2.9[ms]. Consequently, when the pulse having a width of 2.9[ms] serves to rotate the rotor, the motor continues to be rotated by the application of the pulse having a width of 2.9[ms] as it is, and when the pulse having a width of 2.9[ms] does not serve to rotate the rotor, it is driven by the application of the pulse having a width of 7.8[ms]. While the non-rotating condition is detected, the rotor is rotated by the application of the correction driving pulse, and 1 is added to the counting contents of the up/down counter 148. Then the width of the normal driving pulse becomes 3.4[ms] again.

Also, in the timepiece having a calendar mechanism, due to the driving of the calendar mechanism, the load is increased for six hours in a day. In this case, the motor can be driven by a pulse having a width of 3.9[ms], 4.4[ms] and so on during the period of the drive of the calendar mechanism, while a pulse having a width of 3.4[ms] is normally used. When sixteen seconds have elapsed, the pulse which has been extended in pulse width becomes shorter by 0.5[ms]. As a result, the motor can be always driven by the application of the driving pulse having minimum pulse width for driving the rotor and the timepiece can be driven in the condition of minimum power consumption for the motor.

In this embodiment, since the binary counter 143 consists of four stages of flip-flops, the driving pulse and the correction pulse are produced at the same time every sixteen seconds. Due to this fact, if less power consumption is further required, the rate in which the normal driving pulse and the correction driving pulse are produced at the same time can be reduced by further increasing the number of stages of the binary counter 143.

However, if the number of stages of the counter is excessively increased, it takes a long time for the width of the driving pulse to return to the original narrower width when the load becomes small after the pulse width of the driving pulse has been increased for a large load. Thus, when the number of stages of the counter is excessively large, increasing the number of stages becomes meaningless.

An experimental example of the embodiment of the present invention is referred to below.

A man's timepiece in the embodiment has a calendar mechanism and a day of a week mechanism, wherein the diameter of the rotor of the stepping motor is 1.25 mm, the thickness thereof is 0.5 mm, the gap between the rotor and stator is 0.325 mm, the resistance of the coil is 3 KΩ and the number of turns is 10.000.

Table-2 shows the current when the stepping motor is driven by different pulses, the output torque which is measured at the minute hand and a pulse generating ratio of $P_1$ and $P_2$ which is measured by operating the timepiece having the stepping motor for one day.

When 64 pulses "$P_1$" are continuously applied to the stepping motor, the pulse width becomes shorter by one width step whereby the above noted experimental results are attained.

TABLE 2

| | PULSE WIDTH | CURRENT | TORQUE | PULSE GENERATING RATIO |
|---|---|---|---|---|
| | 2.4msec | 0.563μA | 0.38gcm | 87.0% |
| | 2.9msec | 0.647μA | 0.82gcm | 10.0% |
| $P_1$ | 3.4msec | 0.708μA | 1.26gcm | 2.8% |
| | 3.9msec | 0.759μA | 1.44gcm | 0.2% |
| | 4.4msec | 0.816μA | 1.80gcm | 0% |
| $P_2$ | 6.8msec | 1.518μA | 2.76gcm | 0.2% |

Namely, the average current for one day of timepiece operation is obtained by a total of the product of pulse generating ratio and current of the above noted TABLE-2. Accordingly the average current is about 0.58 μA.

If the stepping motor is designed so as to be driven by a $P_2$ pulse width of 6.8 msec, as the result, the average current consumption is reduced from 1.518 μA to 0.58 μA, i.e. a savings in current consumption of 62% is. Therefore, the electronic timepiece having a stepping motor according to the present invention is a great improvement over a conventional one second stepping timepiece having a calendar and a day of the week mechanism.

Figure 23:
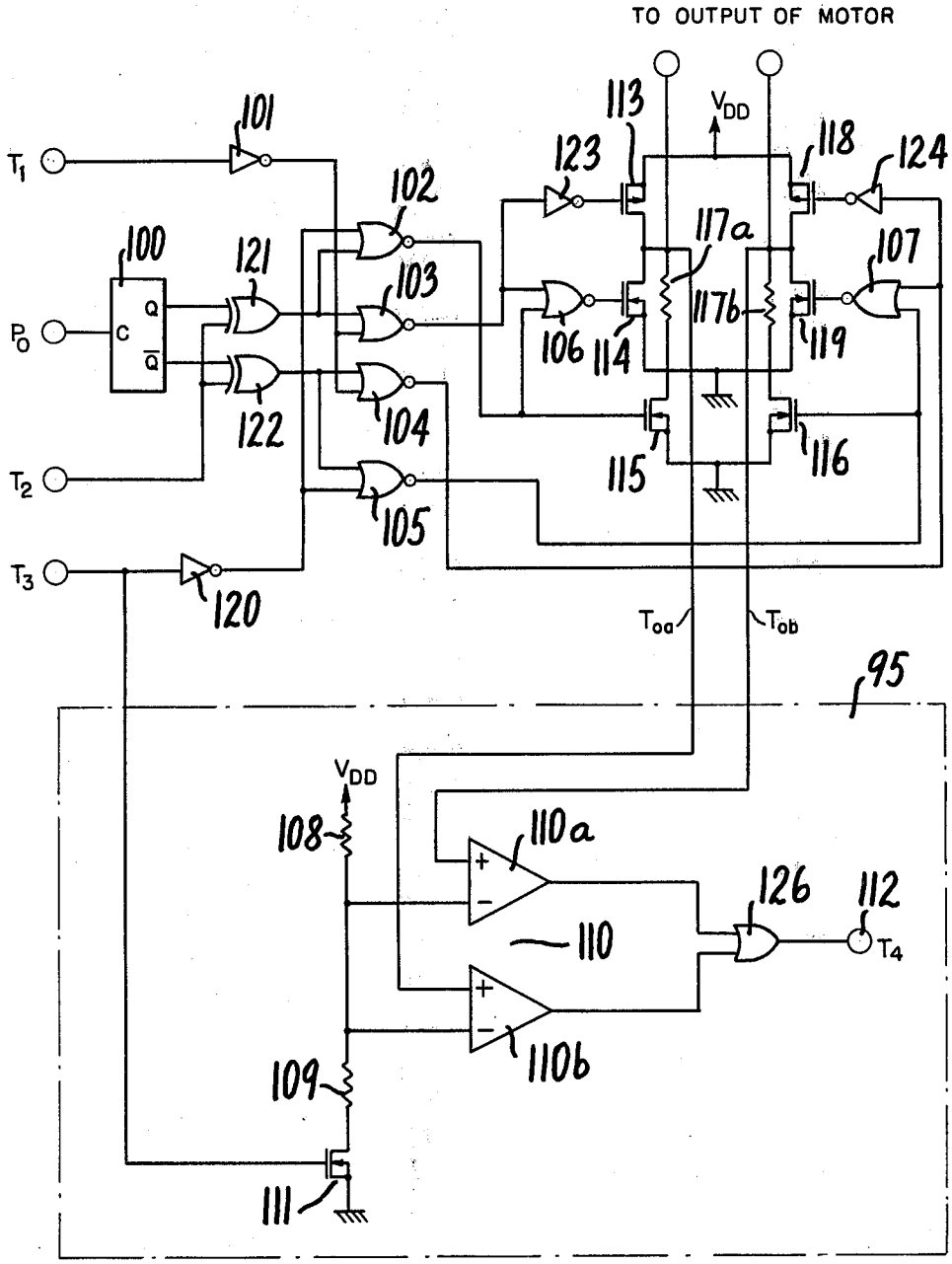
FIG. 23 is another embodiment of the circuitry of FIG. 19.

FIG. 23 shows another embodiment of the driving and detection circuits of FIG. 19. One terminal of a stepping motor is connected to a switching NMOSFET 115 via a detection resistor 117*a* and another terminal is connected to a switching NMOSFET 116 via a detection resistor 117*b*. The terminals of the stepping motor are directly connected to the "+" inputs of comparators 110*a* and 110*b* so that a detection signal which is generated in the coil of the stepping motor is directly treated whereby an accurate detection is attained without a deformation of the detection signal.

The output signal of the comparators 110*a* and 110*b* are digital signals and are applied to OR-gate 126 whereby the output of said OR-gate 126 is applied to a terminal 112.

The output of the terminal 112 is applied as T4 to the circuit of FIG. 22 and therefore it is possible to obtain a very accurate detection of rotation. Further, a standard voltage which is applied to one input terminal of the voltage comparator 110 is changed according to a change of supply voltage $V_{DD}$ in the embodiments of FIGS. 19 and 23. Namely, if the voltage which is applied to the resistors 108 and 109 for setting a standard voltage is constant without connection to a power voltage, it is possible to constantly detect a rotation or non-rotation of the rotor under a constant detection condition whereby the operation of the detection circuit is greatly stabilized.

Figure 24:
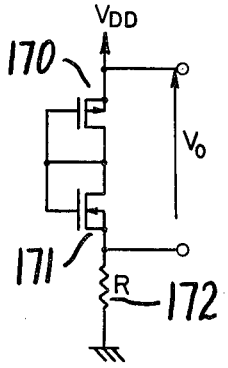
FIG. 24 is a constant voltage circuit.

FIG. 24 shows one embodiment of a constant voltage circuit. The source electrode of PMOSFET 170 is connected to the positive terminal of the power source $V_{DD}$, the gate and drain electrodes are connected to the gate and drain electrodes of NMOSFET 171 and to each other and the source electrode of NMOSFET 171 is connected to the negative terminal of the power source $V_{DD}$ via a resistor 172.

The threshold voltage of PMOSFET 170 is "$V_{TP}$", the K-factor thereof is "$K_p$", the threshold voltage of NMOSFET 171 is "$V_{TN}$", the K-factor thereof is "$K_N$", the resistance of resistor 172 is "RΩ", whereby the following formula is obtained:

$$V_o = V_{TN} + V_{TP} + \sqrt{\frac{V_{DD}}{R_{kP}}} + \sqrt{\frac{V_{DD}}{R_{kN}}}$$

Therefore, if "R" is larger than ($V_{DD}$/kP) and ($V_{DD}$/kN), $V_o$ is not changed even if "$V_{DD}$" is changed.

In the present embodiment, the resistor 172 is 500 kΩ and $V_o$ is about 1.2 V.

As described above, according to the present invention, since all of the elements can be formulated in a MOS-IC and, the conventional stepping motor is driven by a pulse having the minimum pulse width capable of driving it and, there is no factor for increasing the cost, it is possible to drive a conventional motor with minimum power consumption. Therefore, the present invention produces the remarkable effect for a timepiece which is required to make it thin, to make it low in cost and to be miniaturized.

In this embodiment, although the explanation has been given about a motor comprising an one piece stator, the effects obtained by the application of the present invention can be also obtained in the case of the motor comprising two-piece stators as well as the motor comprising a one piece stator.

We claim:

1. In an electronic timepiece having an oscillating circuit for generating a time standard signal; a dividing circuit for dividing the time standard signal into a plurality of lower frequency signals; a stepping motor including a stator, rotor and coil; and a driving circuit for applying driving pulses to the stepping motor coil to effect rotation of the rotor, the improvement comprising: a pulse combining circuit receptive of the lower frequency signals from the dividing circuit for producing correction driving pulses having sufficient effective power to drive the motor under worst case conditions; detecting means for detecting the rotation or non-rotation condition of the rotor and developing a corresponding output signal upon detection of a non-rotation condition; and control means coacting with said pulse combining circuit for producing and controlling the application of normal driving pulses to the driving circuit and responsive to the output signal from said detecting means for effecting the application of a correction driving pulse to the driving circuit when a non-rotation condition is detected, said control means including pulse power minimizing means for producing and applying to the driving circuit within predetermined periods normal driving pulses of decreasing effective power and for producing and applying to the driving circuit normal driving pulses of increasing effective power in response to the detection of a non-rotation condition of the rotor thereby reducing overall the amount of electric power required to rotationally drive the stepping motor during operation of the timepiece.

2. An electronic timepiece as claimed in claim 1; wherein the effective power of each said normal driving pulse is a function of the pulse width of said normal driving pulse.

3. An electronic timepiece as claimed in claim 1; wherein said pulse power minimizing means comprises means for decreasing the effective power of the normal driving pulse applied to the coil after application to the coil of a predetermined plurality of normal driving pulses.

4. An electronic timepiece as claimed in claim 1; wherein the pulse combining circuit further produces a magnetic erasing pulse; and the control means includes means for controlling the driving circuit to apply the magnetic erasing pulse to the stepping motor after the application of a correction driving pulse to eliminate the affect of magnetization in said stator and said coil before application of the next normal driving pulse to said stepping motor coil.

5. An electronic timepiece as claimed in claim 2; wherein the timepiece is resettable; and the control means includes means for memorizing the last pulse width of the normal driving pulse just before the timepiece is reset.

6. An electronic timepiece as claimed in claim 3; wherein said means for decreasing the effective power of the normal pulse applied to the coil after a predetermined number of normal driving pulses includes a counter for counting the predetermined number of normal driving pulses.

7. An electronic timepiece as claimed in claim 2; wherein the pulse power minimizing means includes means for changing the pulse width of the normal driving pulse applied to the coil between a maximum value which is less than that of the correction driving pulse and a non-zero minimum value.

8. An electronic timepiece as claimed in claim 7; wherein the timepiece is resettable; and the means for changing the pulse width of the normal driving pulse includes means for changing the normal driving pulse to one having a pulse width of minimum value after the timepiece is reset.

9. An electronic timepiece as claimed in claim 1; wherein the detecting means includes means for detecting an induced voltage generated by the motion of said rotor which occurs after the application of the normal driving pulse to the coil.

10. An electronic timepiece as claimed in claim 1; wherein said pulse power minimizing means includes means for incrementally decreasing and incrementally increasing the effective power, and wherein the amount of incremental increase of the effective power is equal to the amount of incremental decrease.

11. An electronic timepiece as claimed in claim 9; wherein the means for detecting an induced voltage comprises a detection resistor having a high resistance with respect to that of the stepping motor coil, and means for intermittently connecting the detection resistor to a closed loop including said coil.

12. An electronic timepiece as claimed in claim 11; wherein the resistance of said detection resistor is in the range of about 3 KΩ to 200 KΩ.

* * * * *